US007291820B2

(12) United States Patent
Sin

(10) Patent No.: US 7,291,820 B2
(45) Date of Patent: Nov. 6, 2007

(54) COMPACT MICROWAVE OVEN WITH CURVED COOKING CHAMBER AND CONVECTION PART

(75) Inventor: Mun Su Sin, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/550,452

(22) PCT Filed: Mar. 15, 2004

(86) PCT No.: PCT/KR2004/000550

§ 371 (c)(1),
(2), (4) Date: Jul. 17, 2006

(87) PCT Pub. No.: WO2005/029922

PCT Pub. Date: Mar. 31, 2005

(65) Prior Publication Data

US 2006/0289531 A1 Dec. 28, 2006

(30) Foreign Application Priority Data

Sep. 25, 2003 (KR) ..... 10-2003-0066600
Sep. 25, 2003 (KR) ..... 10-2003-0066601

(51) Int. Cl.
*H05B 6/80* (2006.01)
*F24C 7/00* (2006.01)

(52) U.S. Cl. ..... 219/757; 219/681; 219/400; 126/21 A

(58) Field of Classification Search ..... 219/681–685, 219/756–757, 400–401; 126/21 A
See application file for complete search history.

(56) References Cited

U.S. PATENT DOCUMENTS 4,107,502 A 8/1978 Tanaka et al.
5,674,425 A * 10/1997 Hong ..... 219/681
5,886,328 A 3/1999 Yun
6,320,171 B1 11/2001 Kim

FOREIGN PATENT DOCUMENTS

EP 1335636 A2 8/2003
GB 2 237 487 * 5/1991
JP 61041828 A 2/1986
JP 01-314816 A 12/1989
JP 3-144220 A 6/1991

* cited by examiner

*Primary Examiner*—Philip H. Leung
(74) *Attorney, Agent, or Firm*—Birch, Stewart, Kolasch & Birch, LLP

(57) ABSTRACT

Microwave oven including a base plate (100), a front plate (110) and a rear plate (130) vertically mounted at front and rear edges of the base plate (100), an inner case (200) between the front plate (110) and the rear plate (130) having a curved rear part to form a cooking chamber (200*a*) therein, an outfit chamber (400) at one side of the inner case (200) having various components such as a magnetron (410) and fan (430) mounted therein, and a convection part (300) mounted in rear of the inner case (200) for providing heat to the cooking chamber (200*a*), thereby providing a microwave oven which has a good performance even with a small size.

15 Claims, 7 Drawing Sheets

COMPACT MICROWAVE OVEN WITH CURVED COOKING CHAMBER AND CONVECTION PART

TECHNICAL FIELD

The present invention relates to microwave ovens, and more particularly, to a microwave oven which has a good performance even with a small size.

BACKGROUND ART

In general, the microwave oven cooks food, not by a method identical to a gas oven range that cooks the food by burning gas, but by elevating an inside temperature with electricity or directing a microwave to the food.

Since the microwave oven has no flame, and no hazard of gas leakage, with a less risk for causing accidents coming from negligence of safety compared to the gas oven range, the microwave oven has good response from consumers.

FIG. 1 illustrates a disassembled perspective view of a related art microwave oven, and FIG. 2 illustrates a plan view of a related art microwave oven, schematically.

Referring to FIGS. 1 and 2, the related art microwave oven is provided with a base plate 10, an outer case 12, a front plate 11 and a rear plate 13 at front and rear edges of the base plate 10 respectively, an inner case 20 between the front and rear plates 11 and 13, and an outfit chamber 40 for fitting various components.

The inner case 20 has a cooking chamber 20*a* therein, and the front plate 11 has a door 14 thereon for opening/closing the cooking chamber 20*a*. The outer case 12 covers the inner case 20 and the outfit chamber 40, for protecting the inner case 20 and the outfit chamber 40, together with the front and rear plates 11, and 13.

The rear plate 13 has a plurality of holes 13*a* in a central part in communication with the cooking chamber 20*a* inside of the inner case 20. There is a convection cover 31 mounted on the rear plate 13 to form a convection chamber therein.

In the convection cover 31, there are a heater 32, and a convection fan 34 for blowing air heated by the heater 32 to the cooking chamber 20*a* through the holes 13*a* in the rear plate 13.

There is a convection motor 35 in rear of the convection chamber for driving the convection fan 34. The convection motor 35 has a shaft 35*a* passed through the convection cover 31, and fixed to the convection fan 34.

In the meantime, there is an anti-fan 36 between the convection motor 35 and the convection fan 34, for cooling the convection motor 35. The anti-fan 36 leads an external air to pass through the convection motor 35, and be discharged through a side.

There is a chamber cover 37 in rear of the convection motor 35. The chamber cover 37 covers the convection cover 31 and the convection motor 35, and mounted on the rear plate 13.

FIG. 3 illustrates a back view of a related art microwave oven.

Referring to FIG. 3, the chamber cover 37 has a plurality of air inlet holes 37*a* in a central part for inlet of an external air, and air outlet holes 37*b* in one side part for outlet of the external air passed through the convection motor 35 by the anti-fan 36.

In the meantime, in the outfit chamber 40, there are a magnetron 41 for generating a microwave, a transformer 42 for supplying a high voltage to the magnetron 41, and a fan 43 for introduction of external air into the outfit chamber 40.

The fan 43 is fixed to a fan motor 44 mounted on the rear plate 13, and driven by the fan motor 44, for introducing the external air into the outfit chamber 40 to cool components, such as the magnetron 41, and the transformer 42 which generate heat during operation.

However, the related art microwave oven has the following problems.

First, the thickness of the convection cover 31 and the chamber cover 37 mounted on the rear plate 13 increases an overall size of the related art microwave oven, to cause difficulty in installation, and required much space.

Second, the hexahedral inner case 20, and the cooking chamber 20*a* formed therein cause difficulty in cleaning corner parts of the cooking chamber 20*a*, and concentration of the microwave on the corner parts, that impedes uniform heating of food.

Third, the provision of a separate anti-fan for cooling the convection motor 35 increases production cost, and requires an extra mounting process.

DISCLOSURE OF INVENTION

An object of the present invention is to provide a microwave oven which has a good performance even if a size of the microwave oven is small.

Additional features and advantages of the invention will be set forth in the description which follows, and in part will be apparent to those having ordinary skill in the art upon examination of the following or may be learned from practice of the invention. The objectives and other advantages of the invention will be realized and attained by the structure particularly pointed out in the written description and claims hereof as well as the appended drawings.

To achieve these objects and other advantages and in accordance with the purpose of the present invention, as embodied and broadly described herein, the microwave oven includes a base plate, a front plate and a rear plate vertically mounted at front and rear edges of the base plate, an inner case between the front plate and the rear plate having a curved rear part to form a cooking chamber therein, an outfit chamber at one side of the inner case having various components such as a magnetron and fan mounted therein, and a convection part mounted in rear of the inner case for providing heat to the cooling chamber.

The rear part of the inner case is spaced from the rear plate. The rear plate has a part opposite to the rear part of the inner case pressed backward.

The inner case has a width that becomes the smaller as it goes the farther from a front plate side to a rear plate side.

The rear plate has a plurality of second air inlet holes for receiving external air as the fan is operated, and the inner case has first air inlet holes for guiding heat from the convection part to the cooking chamber.

The convection part includes a heater for generating heat, a convention fan for blowing air heated by the heater to the cooking chamber, and a convection motor for driving the convection fan.

The inner case has first inlet holes for guiding high temperature air blown by the convection fan to the cooking chamber, and the convection part further includes an anti-fan between the convection motor and the convection fan for cooling the convection motor.

The convection part further includes a convection case mounted on the inner case and surrounding the convection fan and heater.

The convection part further includes an anti-fan between the convection motor and the convection case for cooling the convection motor. The inner case having the convection case mounted thereon has first inlet holes for guiding high temperature air the convection fan blows to the cooking chamber.

The microwave oven further includes a first shielding plate between the convection part and the outfit chamber for cutting off heat from the convection part.

The convection part includes a heater for generating heat, a convention fan for blowing air heated by the heater to the cooking chamber, and a convection motor for driving the convection fan.

The convection part further includes a convection case mounted on the inner case and surrounding the convection fan and heater.

The first shielding plate has a second outlet hole for cooling the convection motor, and the inner case has first inlet holes for guiding high temperature air blown by the convection fan to the cooking chamber.

The microwave oven further includes a second shielding plate between the convection fan and the convection motor for preventing the heat from directly transmitting to the convection motor.

The convection part further includes a convection case surrounding the convection fan and heater, and mounted on the inner case.

The inner case has first inlet holes at a part the convection case mounted thereon for guiding high temperature air blown by the convection fan to the cooking chamber.

It is to be understood that both the foregoing description and the following detailed description of the present invention are exemplary and explanatory and are intended to provide further explanation of the invention claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention.

In the drawings.

BEST MODE FOR CARRYING OUT THE INVENTION

Reference will now be made in detail to the preferred embodiments of the present invention, examples of which are illustrated in the accompanying drawings. In describing the embodiments of the present invention, identical parts will be given the same names and reference symbols, and repetitive description of which will be omitted.

Figure 1:
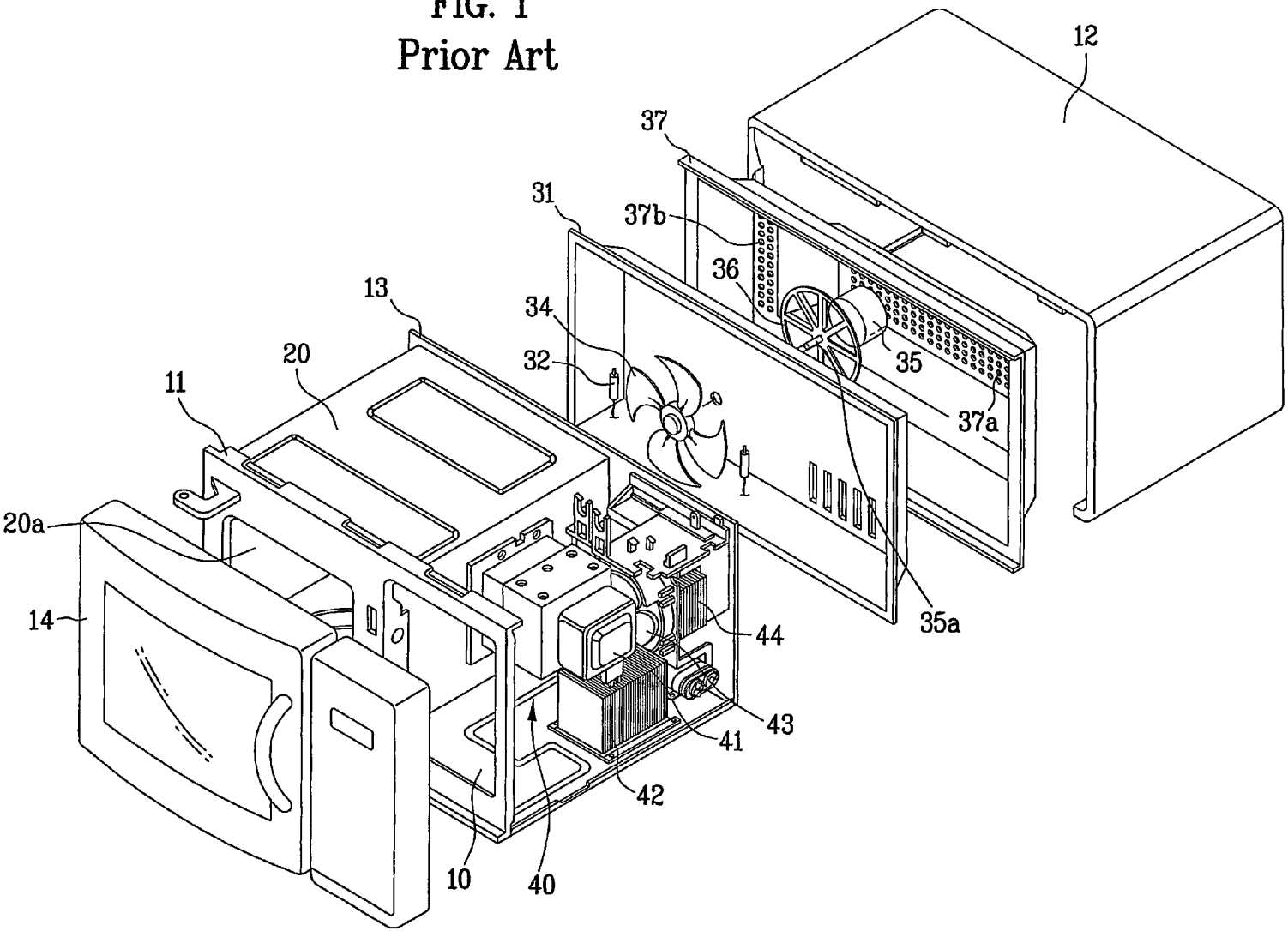
FIG. 1 Prior Art
FIG. 1 illustrates a disassembled perspective view of a related art microwave oven.
Figure 2:
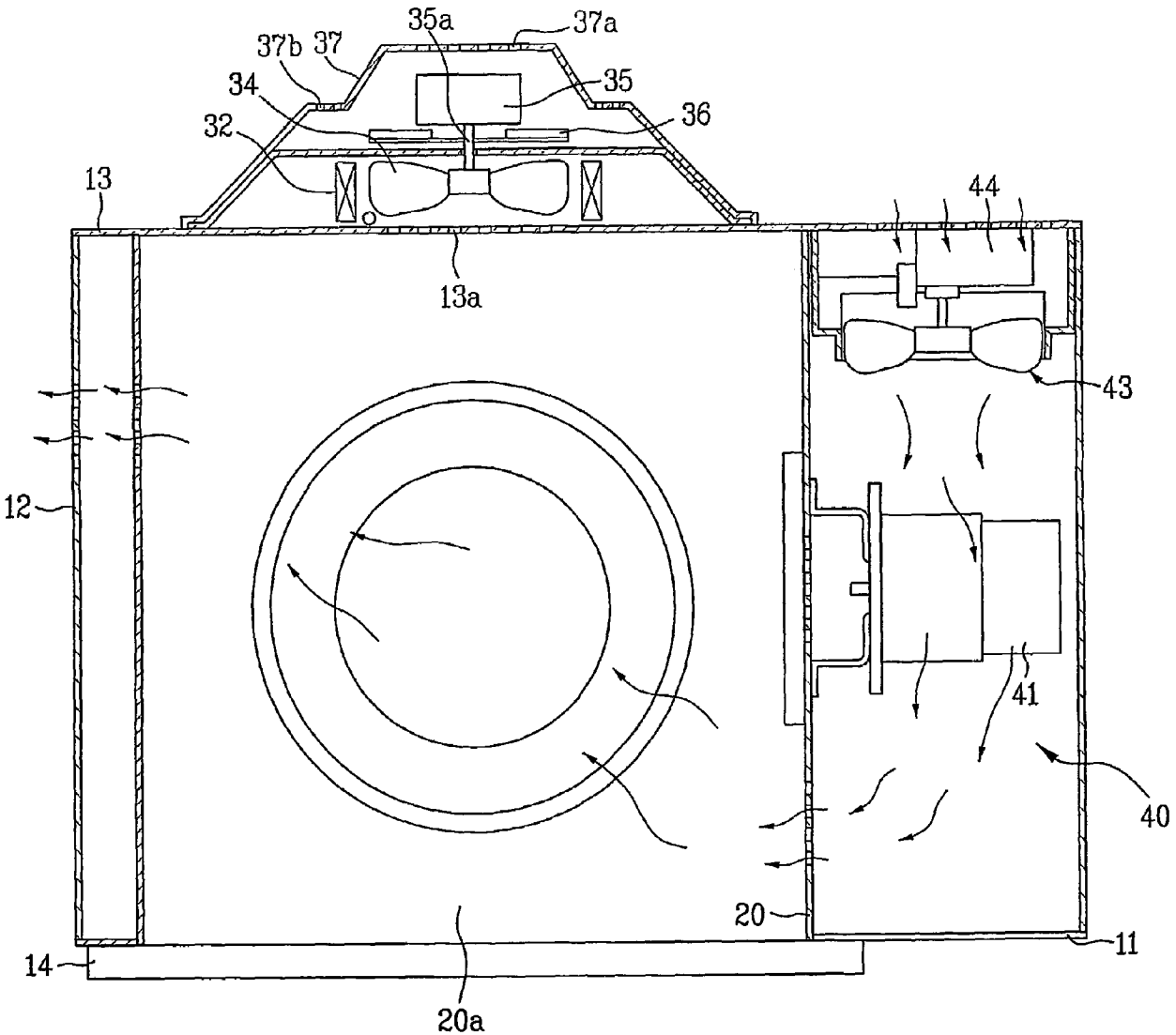
FIG. 2 Prior Art
FIG. 2 illustrates a section of a related art microwave oven, schematically.
Figure 3:
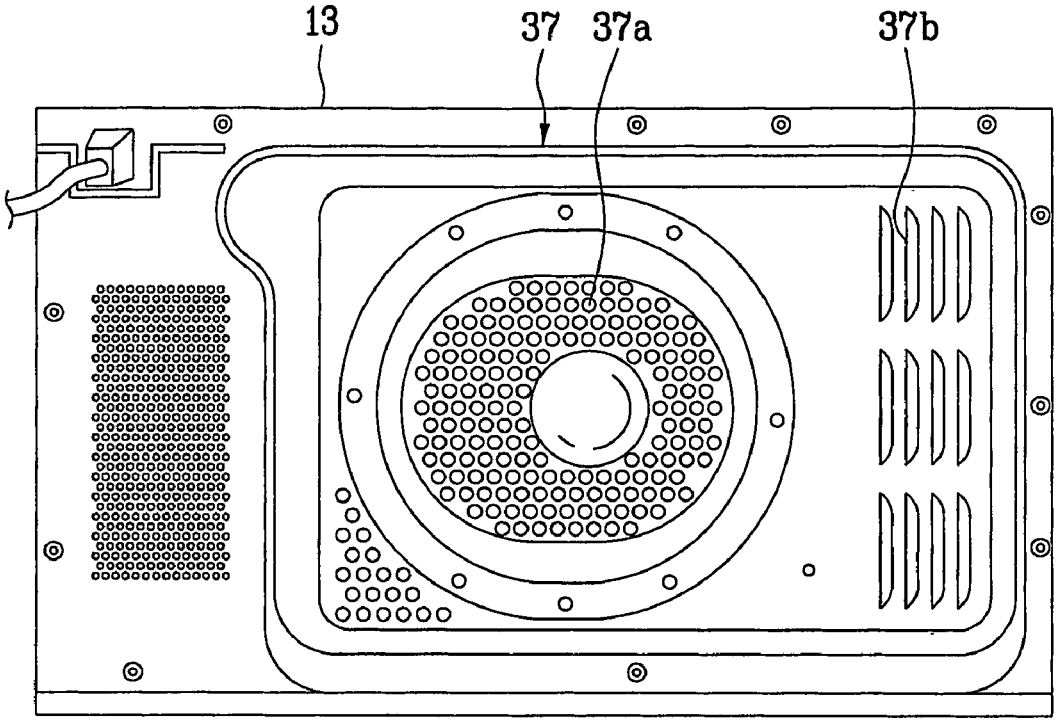
FIG. 3 Prior Art
FIG. 3 illustrates a back view of a related art microwave oven.
Figure 4:
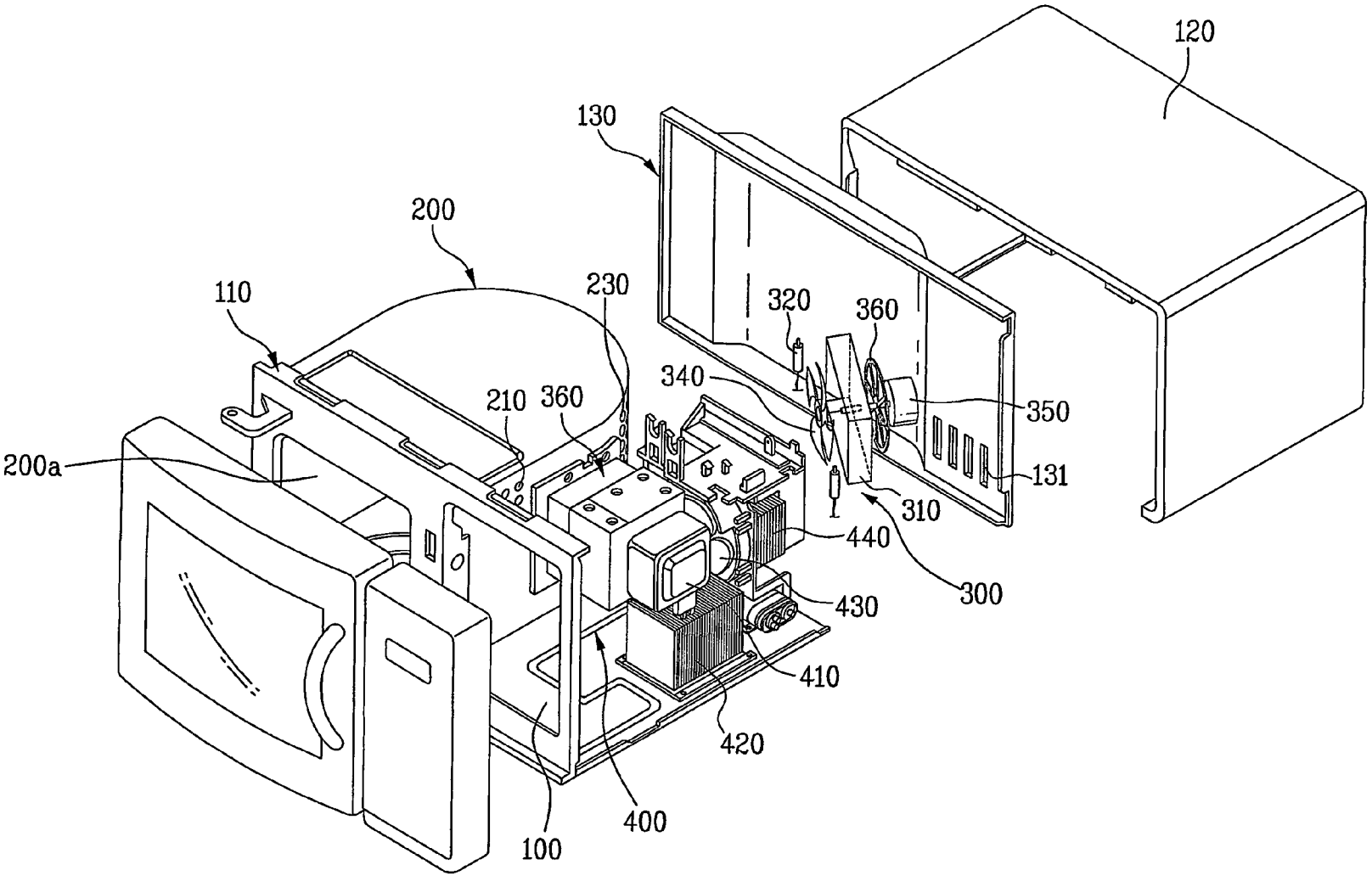
FIG. 4 illustrates a disassembled perspective view of a microwave oven in accordance with a first preferred embodiment of the present invention.
Figure 5:
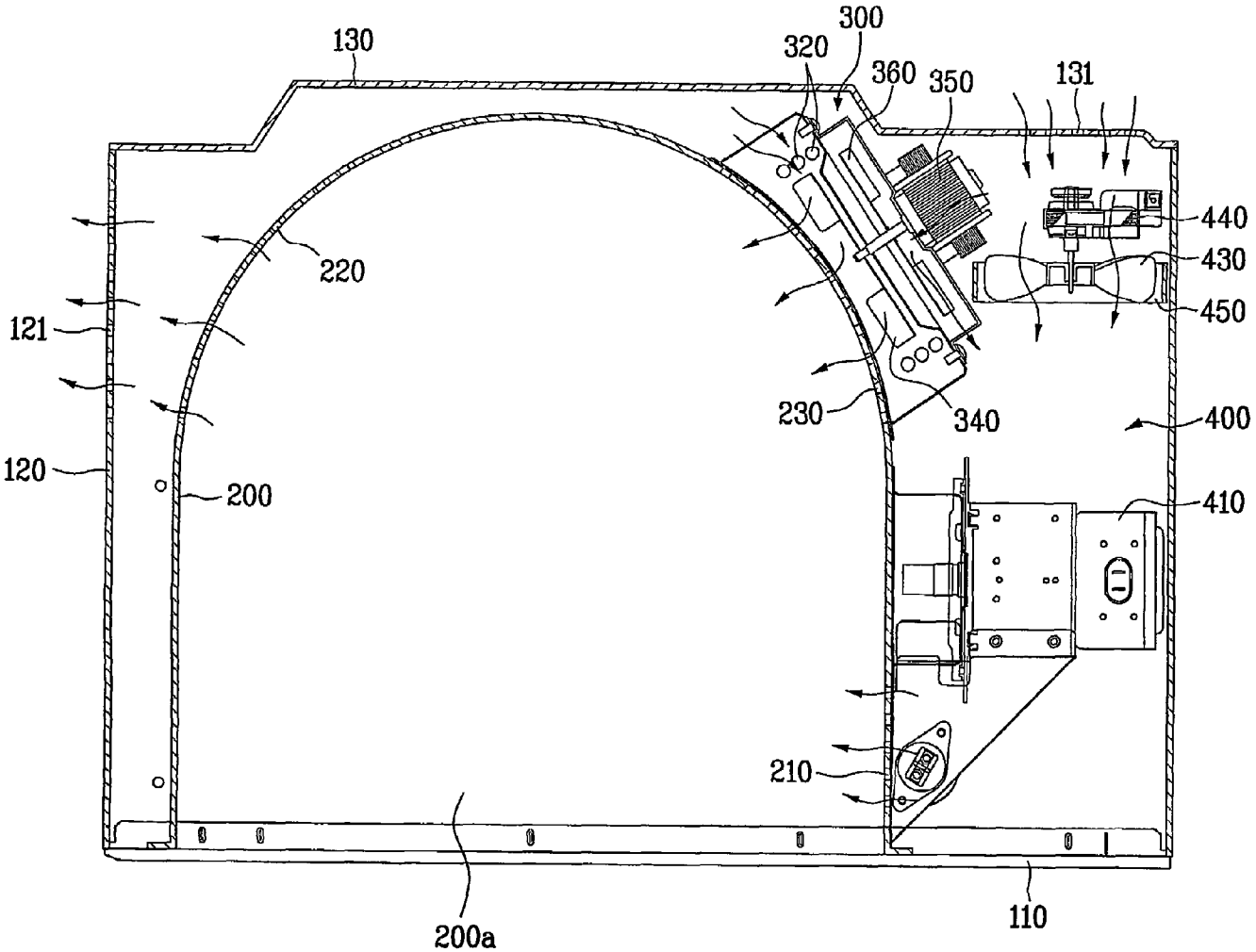
FIG. 5 illustrates a section of a microwave oven in accordance with a first preferred embodiment of the present invention, schematically.

FIG. 4 illustrates a disassembled perspective view of a microwave oven in accordance with a first preferred embodiment of the present invention, and FIG. 5 illustrates a section of a microwave oven in accordance with a first preferred embodiment of the present invention, schematically.

Referring to FIGS. 4 and 5, the microwave oven includes a base plate 100, an outer case 120, a front plate 110 and a rear plate 130 vertically mounted at front and rear edges of the base plate 100, an inner case 200, an outfit chamber 400, and a convection part 300.

The outer case 120 protects the inner case 200, the outfit chamber 400, and the convection part 300 from an external impact, together with the front and rear plates 110, and 130.

The inner case 200, between the front plate 110 and the rear plate 130, forms a cooking chamber 200*a* therein. The inner case 200 has a curved rear part spaced from the rear plate 130. For this, a part of the rear plate 130 opposite to the rear part of the inner case 200 is pressed backward, to form a space between the rear part of the inner case 110 and the rear plate 130 for smooth circulation of air.

Of course, a size of the inner case 200 may be made smaller for providing a space between the rear part of the inner case 200 and the rear plate 130. However, since a size of the cooking chamber 200*a* becomes also smaller, if the size of the inner case 200 is made smaller, it is preferable that the rear plate 130 is pressed backward.

The inner case 200 has first air inlet holes 210 and first air outlet holes 220 in both sides in communication with the cooking chamber 200*a*. Also, the outer case 120 has second air outlet hole 121 opposite to the first air outlet holes 220.

There may be many variations of the inner case 200, such that a width of the inner case 200 is formed the smaller as it goes the farther from a front plate 110 side to a rear plate 130 side of the inner case 200, or an entire inner case 200 has a form of a semi-circle.

The outfit chamber 400, at one side of the inner case 200, has various components, such as a magnetron 410, and a fan 430, mounted therein. The magnetron 410 at one side of the inner case 200 directs a microwave to the cooking chamber 200*a*, and the fan 430, between the magnetron 410 and the rear plate 130, draws external air into the outfit chamber 400.

There is a transformer 420 under the magnetron 410 for transforming a power from an outside of the microwave oven into a power of high voltage, and supplying to the magnetron 410, and the fan 430 is fixed to a shaft of the fan motor 440.

The fan 430 and the fan motor 440 are spaced from the rear plate 130, and the rear plate 130 has a plurality of second air inlet holes 131 for passing the external air introduced by the fan 430. Accordingly, if the fan 430 is put into operation, the external air is introduced into the outfit chamber 400 through the second air inlet holes 131, and cools the magnetron 410 and the transformer 420.

The convection part 300, in rear of the inner case 200, transfers heat to the cooking chamber 200*a*. In more detail, the convection part 300 is mounted in a space formed in rear of the inner case 200 as the rear of the inner case 200 is curved. It is preferable that the convection part 300 is mounted at a part adjacent to the outfit chamber 400 for enabling easy leading of different wires, and easy maintenance. In the meantime, the inner case 200 has first air inlet holes 230 for guiding the heat from the convection part 300 to the cooking chamber 200*a*.

The convection part 300 includes a heater 320, a convection fan 340, and a convection motor 350.

The heater 320 generates heat at a high temperature to heat ambient heat for providing heat to the cooking chamber 200*a*, and the convection fan 340 blows the air heated by the heater 320 to the cooking chamber 200*a*. That is, the convection fan 340 blows high temperature air to the cooking chamber 200*a* through the first passing through holes 230 in the inner case 200. The convection motor 350, coupled to the convection fan 340 with a shaft, drives the convection fan 340.

In the meantime, the convection part 300 further includes an anti-fan 360 between the convection motor 350 and the convection fan 340 for cooling the convection motor 350. The anti-fan 360 coupled to the convection motor 350 with a shaft, leads air introduced into the outfit chamber 400 through second air inlet holes 131 in the rear plate 130 to pass through the convection motor 350 and discharged through a side surface.

The convection part 300 further includes a convection case 310 mounted to the inner case 200 to surround the convection fan 340 and the heater 320. The convection case 310 cuts off transmission of the heat from the heater 320 to the convection motor 350 and the various components in the outfit chamber 400, and prevents the convection motor 350 and the various components suffering from damage.

That is, when the heater 320 and the convection fan 340 are in operation, it is liable that the heat of the heater 320 is directly transmitted to, and damages the convection motor 350 and the magnetron 410. The convection case 310 isolates the heater 320 and the convection fan 340 from other components, to prevent the heat from transmitting to other components directly.

For cooling the convection motor 350, it is preferable that the anti-fan 360 is provided between the convection motor 350 and the convection case 310. The first air inlet holes 230 are formed in the inner case 200 having the convection case 310 mounted thereon for guiding high temperature air blown by the convection fan 340 to the cooking chamber 200*a*.

The operation of the microwave oven in accordance with a first preferred embodiment of the present invention will be described.

When the user puts the microwave oven into operation, the convection heater 320 generates heat to heat air, and the convection fan 340 rotates as the convection motor 350 is driven.

According to this, the convection fan 340 blows air heated by the heater 320 to the cooling chamber 200*a* through the first air inlet holes 230 in the inner case 200, to cook the food in the cooking chamber 200*a*.

In this instance, the heat from the heater 320 is cut off at the convection case 310, to prevent the heat from transmitting to the convection motor 350, and the components in the outfit chamber 400, directly. Moreover, as the convection motor 350 is operated, the convection motor 350 is cooled as the anti-fan 360 is operated.

In the meantime, when the fan motor 440 in the outfit chamber 400 is operated, external air is introduced into the outfit chamber 400 through the second air inlet holes 131 in the rear plate 130 as the fan 430 rotates.

The air introduced into the outfit chamber 400 passes through components, such as the magnetron 410 and the transformer 420. According to this, components generating much heat during operation, such as the magnetron 410, are cooled by air introduced into the outfit chamber 400 by the fan 430.

The air passed through the magnetron and the like is introduced into the cooking chamber 200*a* through the first air inlet holes 210 in the inner case 200. Then, the air introduced into the cooking chamber 200*a* is discharged to an outside of the microwave oven through the first air outlet holes 220 in the inner case 200 and the second air outlet holes 121 in the outer case 120, together with smell and moisture generated during cooking the food.

Figure 6:
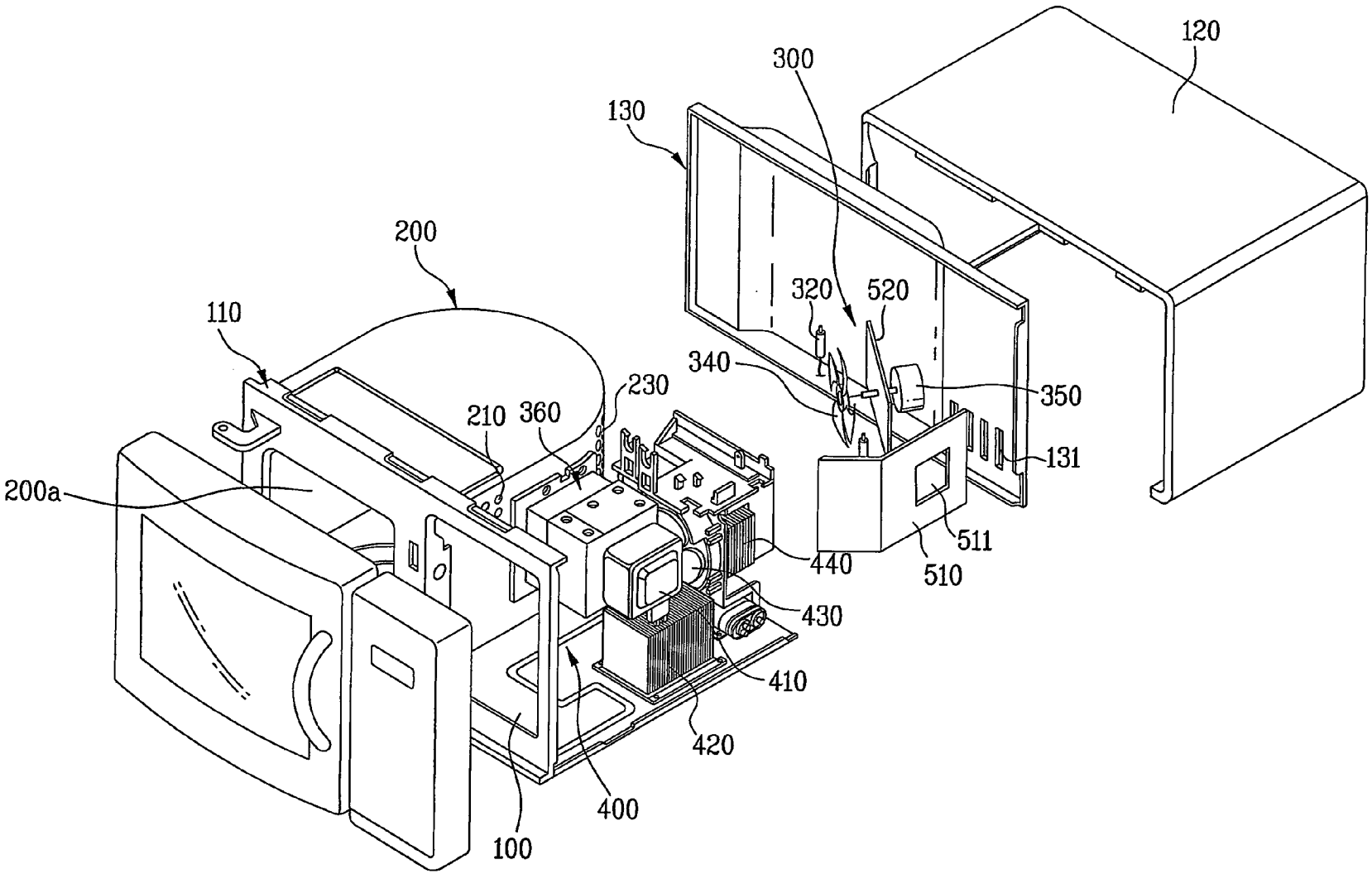
FIG. 6 illustrates a disassembled perspective view of a microwave oven in accordance with a second preferred embodiment of the present invention.
Figure 7:
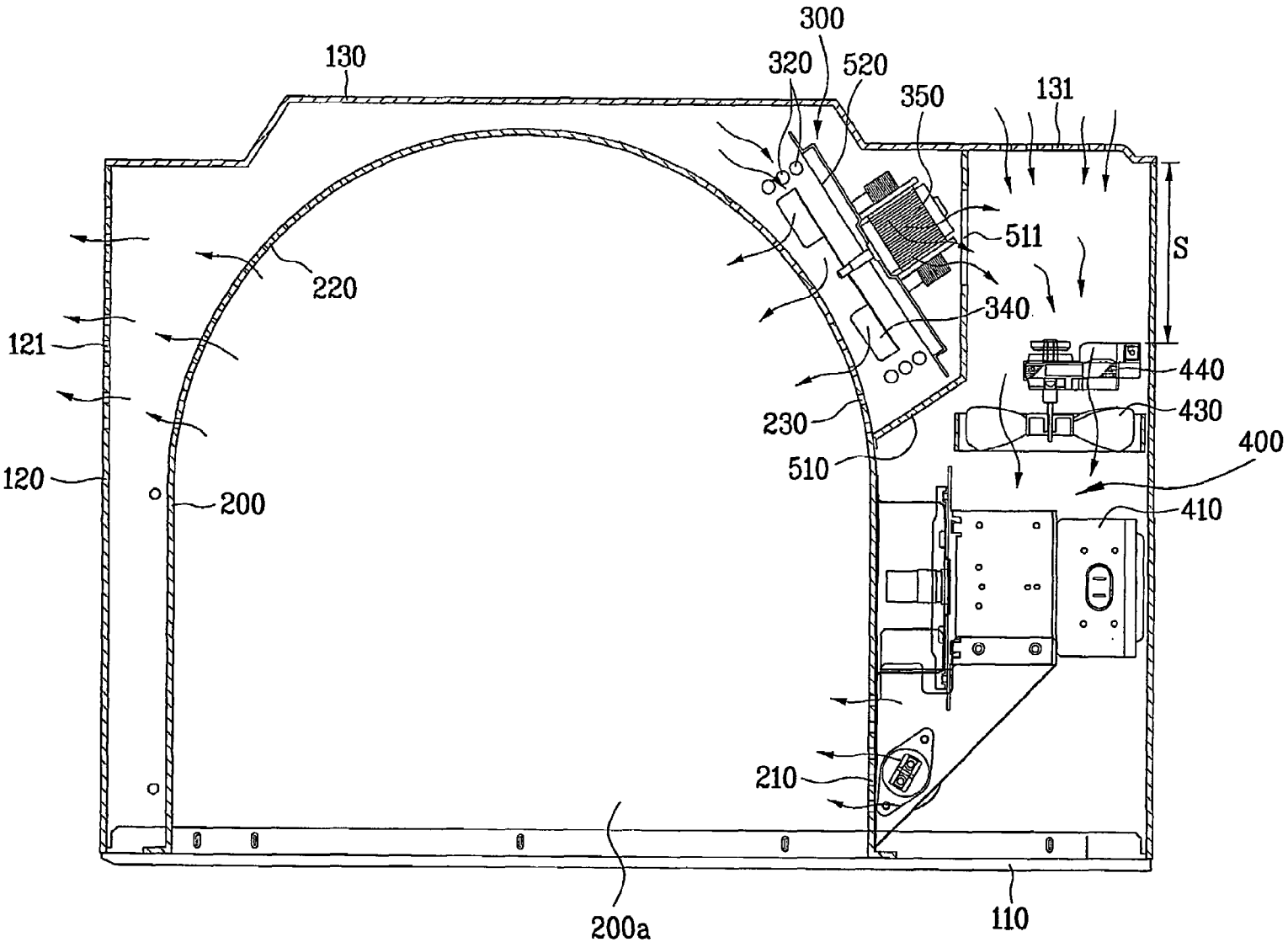
FIG. 7 illustrates a section of a microwave oven in accordance with a second preferred embodiment of the present invention, schematically.

FIG. 6 illustrates a disassembled perspective view of a microwave oven in accordance with a second preferred embodiment of the present invention, and FIG. 7 illustrates a section of a microwave oven in accordance with a second preferred embodiment of the present invention, schematically.

Referring to FIGS. 6 and 7, alike the first embodiment, the microwave oven includes a base plate 100, an outer case 120, a front plate 110 and a rear plate 130 vertically mounted at front and rear edges of the base plate 100, an inner case 200, an outfit chamber 400, and a convection part 300.

The inner case 200, between the front plate 110 and the rear plate 130, forms a cooking chamber 200*a* therein. The inner case 200 has a curved rear part.

The outfit chamber 400, at one side of the inner case 200, has various components, such as a magnetron 410 and a fan 430, mounted therein. The convection part 300, in rear of the inner case 200, transfers heat to the cooking chamber 200*a*.

There is a first shielding plate 510 between the convection part 300 and the outfit chamber 400 for shielding heat from the convection part 300. The first shielding plate 510 isolates the convection part 300 from the outfit chamber 400, for preventing the heat of the convection part 300 from transmitting to the components in the outfit chamber 400, directly.

The convection part 300 includes a heater 320, a convection fan 340, and a convection motor 350.

In the meantime, the convection motor 350 is liable to suffer from damage by heat generated at the convection motor 350 itself. Therefore, the first shielding plate 510 has a second outlet hole 511 for cooling the convection motor 350.

The second outlet hole 511, made to communicate the convection part 300 with the outfit chamber 400, discharges heat from the convection motor 350 to the outfit chamber 400. In more detail, if external air is introduced into the outfit chamber 400 by the fan 430, a pressure difference is formed between the outfit chamber 400 and a space the convection motor 350 is therein, to produce an air flow from the convection motor 350 to the fan 430. Then, heat from the convection motor 350 moves following the air introduced into the outfit chamber 400 from the convection motor 350 through the second outlet hole 511. At the end, the convection motor 350 can be cooled down as the heat is discharged through the second outlet hole 511.

Therefore, even if the second embodiment microwave oven has no separate cooling means, such as the anti-fan 360 (see FIGS. 4 and 5), the microwave oven can cool down the convection motor 350 smoothly through the second outlet hole 511.

The inner case 200 has a first inlet holes 230 in the inner case 200 for guiding high temperature air the convection fan 340 blows to the cooking chamber 200*a*.

There is a second shielding plate 520 between the convection fan 340 and the convection motor 350, for preventing the heat of the heater from transmitting to the convection motor 350 directly.

In the meantime, the convection part 300 may further include a convection case 310 (see FIGS. 4 and 5) which is mounted on the inner case 200 and surrounds the convection fan 340 and the heater 320.

As described before, the convection case 310 cuts off transmission of the heat of the heater 320 to the various components in the outfit chamber 400, as well as direct transmission of the heat of the heater 320 to the convection motor 350.

Accordingly, the convection case 310 cuts off direct transmission of the heat of the heater 320 to the components in the outfit chamber 400 together with the first shielding plate 510, as well as to the convection motor 350 together with the second shielding plate 520.

At the end, the heat of the heater 320 is shielded doubly with the first and second shielding plates 510 and 520, and the convection case 310. Of course, in a case the convection case 310 is fitted, the second shielding plate 520 may be removed.

The operation of the second embodiment microwave oven of the present invention will be described.

Alike the first embodiment, when the user puts the microwave oven into operation, the convection heater 320 generates heat to heat air, and the convection fan 340 rotates as the convection motor 350 is driven.

According to this, the convection fan 340 blows the air heated by the heater 320 to the cooking chamber 200*a* through the first inlet holes 230 in the inner case 200, to cook the food in the cooking chamber 200*a*.

In this instance, since the convection part 300 is isolated from the outfit chamber 400 by the first shielding plate 510, direct transmission of the heat of the heater 320 in the convection part 300 to the outfit chamber 400 is cut off by the first shielding plate 510.

Of course, if the convection case 310 is provided, the direct transmission of the heat of the heater 320 to the convection motor 350 and the outfit chamber 400 is cut off by the first, and second shielding plate 510, and the 520, and the convection case 310.

In the meantime, if the fan motor 440 in the outfit chamber 400 is driven, the fan 430 rotates, to draw external air into the outfit chamber 400 through the second air inlet holes 131 in the rear plate 130. In this instance, the heat from the convection motor 350 is discharged to the outfit chamber 400 through the second outlet hole 511 in the first shielding plate 510.

The external air introduced into the outfit chamber 400 by the fan 430 passes through the components, such as the magnetron 410 and the transformer 420. Therefore, components like the magnetron 410 which generates much heat during operation is cooled by the external air introduced into the outfit chamber 400 by the fan 430.

The air passed through the magnetron 410 and the like is introduced into the cooking chamber 200*a* through the first air inlet holes 210 in the inner case 200.

Then, the air introduced into the cooling chamber 200*a* is discharged to an outside of the microwave oven through the first air outlet holes 220 in the inner case 200 and the second air outlet holes 121 in the outer case 120.

INDUSTRIAL APPLICABILITY

The present invention has the following advantages.

First, the curved rear part of the inner case to form a rear part of the cooking chamber curved too permits an easy cleaning of an inside of the cooking chamber.

Second, the curved rear part of the cooking chamber prevents the microwave from concentrating on corners of the cooking chamber, thereby enabling uniform heating of food.

Third, the curved rear part of the inner case enabling to provide a convection part in a space formed accordingly permits to reduce an overall size of the microwave.

Fourth, the possibility of cooling the convection motor without using a separate anti-fan permits to reduce a production cost, and simplifies an assembly process.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A microwave oven comprising:

a base plate;

a front plate and a rear plate vertically mounted at front and rear edges of the base plate;

an inner case between the front plate and the rear plate having a curved rear part to form a cooking chamber therein;

an outfit chamber at one side of the inner case, magnetron and a fan being located in the outfit chamber;

a convection part mounted in rear of the inner case for providing heat to the cooking chamber, the convection part including a convection motor; and a first shielding plate located between the convection part and the outfit chamber for cutting off the heat transmitting from the convection part to the outfit chamber, the first shielding plate having at least one outlet hole, the fan in the outfit chamber drawing air surrounding the convection motor to pass through the at least one outlet hole into the outfit chamber so as to cool the convection motor.

2. The microwave oven as claimed in claim 1, wherein the rear part of the inner case is spaced from the rear plate.

3. The microwave oven as claimed in claim 2, wherein the rear plate has a part opposite to the rear part of the inner case pressed backward.

4. The microwave oven as claimed in claim 1, wherein the inner case has a width that becomes the smaller as it goes the farther from a front plate side to a rear plate side.

5. The microwave oven as claimed in claim 1, wherein the rear plate has a plurality of second air inlet holes for receiving external air as the fan is operated.

6. The microwave oven as claimed in claim 1, wherein the inner case has first air inlet holes for guiding heat from the convection part to the cooking chamber.

7. The microwave oven as claimed in claim 1, wherein the convection part further includes;

a heater for generating heat, and a convention fan for blowing air heated by the heater to the cooking chamber, wherein the convection motor is for driving the convection fan.

8. The microwave oven as claimed in claim 7, wherein the inner case has first inlet holes for guiding high temperature air blown by the convection fan to the cooking chamber.

9. The microwave oven as claimed in claim 7, wherein the convection part further includes an anti-fan between the convection motor and the convection fan for cooling the convection motor.

10. The microwave oven as claimed in claim 7, wherein the convection part further includes a convection case mounted on the inner case and surrounding the convection fan and heater.

11. The microwave oven as claimed in claim 10, wherein the convection part further includes an anti-fan between the convection motor and the convection case for cooling the convection motor.

12. The microwave oven as claimed in claim 10, wherein the inner case having the convection case mounted thereon has first inlet holes for guiding high temperature air the convection fan blows to the cooking chamber.

13. The microwave oven as claimed in claim 1, further comprising a second shielding plate between the convection fan and the convection motor for preventing the heat from directly transmitting to the convection motor.

14. The microwave oven as claimed in claim 13, wherein the convection part further includes a convection case surrounding the convection fan and heater, and mounted on the inner case.

15. The microwave oven as claimed in claim 14, wherein the inner case has first inlet holes at a part the convection case mounted thereon for guiding high temperature air blown by the convection fan to the cooking chamber.

* * * * *